US011835256B1

(12) United States Patent
Li

(10) Patent No.: US 11,835,256 B1
(45) Date of Patent: Dec. 5, 2023

(54) DRIPPING HUMIDIFIER

(71) Applicant: Fang Li, Shenzhen (CN)

(72) Inventor: Fang Li, Shenzhen (CN)

( * ) Notice: Subject to any disclaimer, the term of this patent is extended or adjusted under 35 U.S.C. 154(b) by 0 days.

(21) Appl. No.: 18/462,735

(22) Filed: Sep. 7, 2023

(51) Int. Cl.

| | |
|---|---|
| ***F24F 6/02*** | (2006.01) |
| ***F24F 6/04*** | (2006.01) |
| *F21V 33/00* | (2006.01) |
| *F24F 6/00* | (2006.01) |

(52) U.S. Cl.
CPC ..... *F24F 6/04* (2013.01); *F21V 33/0044* (2013.01); *F24F 2006/001* (2013.01); *F24F 2006/046* (2013.01)

(58) Field of Classification Search
CPC ..... F24F 6/02; F24F 6/04; F24F 6/12; F24F 6/14; F24F 2006/001; F24F 2006/003; F24F 2006/046; F21V 33/0044
USPC ..... 261/36.1, 75
See application file for complete search history.

(56) References Cited

U.S. PATENT DOCUMENTS

| | | | | |
|---|---|---|---|---|
| 5,226,935 A * | 7/1993 | Wolff | F24F 6/04 | 96/240 |
| 6,257,560 B1 * | 7/2001 | Kim | B05B 1/265 | 261/36.1 |
| 2012/0112371 A1 * | 5/2012 | Kanel | F24F 6/02 | 261/157 |
| 2018/0100666 A1 * | 4/2018 | Park | F24F 6/04 | |
| 2021/0140656 A1 * | 5/2021 | Seo | C02F 1/46104 | |
| 2023/0136098 A1 * | 5/2023 | Li | F24F 6/04 | 261/28 |

FOREIGN PATENT DOCUMENTS

| | | | |
|---|---|---|---|
| CN | 205372900 U | * | 7/2016 |
| CN | 106545944 A | * | 3/2017 |
| CN | 106813339 A | * | 6/2017 |
| CN | 107504577 A | * | 12/2017 |

(Continued)

OTHER PUBLICATIONS

Partial English Translation of CN 205372900 U (Year: 2016).*

(Continued)

*Primary Examiner* — Charles S Bushey
(74) *Attorney, Agent, or Firm* — Vladimir Postnikov

(57) ABSTRACT

A dripping humidifier is disclosed, including a base. The base inside is configured with a miniature water pump and a storage water tank, a top of the base on opposing sides are configured with columns. A cloud sink is configured to mount on connections of the columns on the opposing sides, the columns are configured with internal pipes that connect to the miniature water pump and the cloud sink respectively, the cloud sink is uniformly configured with drip outlets at bottom. The base is configured with an opening on a top wall, and the opening in the base is fitted with a splash guard and a ring. The splash guard is configured with a water intake, the ring is distributed around the opening in the base and protrudes from the base. The dripping humidifier of the present disclosure through multiple drip outlets to increase water droplets and humidification effect, and the water droplets are not easy to splash and not wet the desktop. An overall appearance of the product is beautiful, and the night light effect is good, with a decorative effect.

8 Claims, 4 Drawing Sheets

(56) References Cited

FOREIGN PATENT DOCUMENTS

| | | | |
|---|---|---|---|
| CN | 111854021 A | * | 10/2020 |
| CN | 113108395 A | * | 7/2021 |

OTHER PUBLICATIONS

Partial English Translation of CN 106545944 A (Year: 2017).*
Partial English Translation of CN 106813339 A (Year: 2017).*
Partial English Translation of CN 107504577 A (Year: 2017).*
Partial English Translation of CN 111854021 A (Year: 2020).*
Partial English Translation of CN 113108395 A (Year: 2021).*

* cited by examiner

DRIPPING HUMIDIFIER

TECHNICAL FIELD

The present application belongs to the technical field of humidifiers, and specifically to a novel dripping humidifier.

BACKGROUND

Humidifier is a household appliance that increases humidity of a room. The humidifier may humidity the room or an entire building in conjunction with a boiler or a central air conditioning system. After years of popularizing concept of air quality, product development, and market cultivation, functions and roles of the humidifier, a relatively unfamiliar small household appliance, have gradually been accepted. As one kind of humidifiers, a dripping humidifier through uninterrupted dripping, imitating rainy day to the room for a gentler humidification, has been more and more widely used. In the process of work, first through a water pump in the water supply tank to a high place, and then water flow in the high place under an action of gravity drip into the water supply tank, in the process of dripping water may be humidified in the room.

However existing dripping humidifiers have following technical problems. 1) There only is a single-hole water outlet, and humidification effect is poor. 2) Dripping not anti-splash and anti-splash enclosure cannot be disassembled and difficult to clean. 3) Some products use a single-hole water outlet in a middle column, resulting in a support column in the middle, the column occupies part of space, thus affecting dripping effect, and the water drop effect is general. Therefore, in response to the above technical problems, the present disclosure proposes a novel dripping humidifier.

SUMMARY

To address above problems, the present disclosure provides a novel dripping humidifier with multiple drip outlets to increase an effect of water droplets and humidification, the water droplets are not easy to splash and will not wet the desktop. An overall appearance of the dripping humidifier is beautiful, with good lighting atmosphere and decorative effect.

In order to realize above functions, the present disclosure adopts technical solutions as follows. In some embodiments, the dripping humidifier provided by the present disclosure includes a base. The base inside is configured with a miniature water pump and a storage water tank, a top of the base on opposing sides are configured with columns. A cloud sink is configured to mount on connections of the columns on the opposing sides, the columns are configured with internal pipes that connect to the miniature water pump and the cloud sink respectively, the cloud sink is uniformly configured with drip outlets at bottom. The base is configured with an opening on a top wall, and the opening in the base is fitted with a splash guard and a ring. The splash guard is configured with a water intake; the ring is distributed around the opening in the base and protrudes from the base.

In a further preferred embodiment, the splash guard is configured as a conical platform at a center, the splash guard is configured with a curved surface on a peripheral wall, and the splash guard is configured with the water intake at the center and at the curved surface thereof. The splash guard is configured with an outer periphery at an outermost side, the outer periphery is inclined and slopes downwardly from an outer edge of the splash guard towards the center. The base is configured with a step surface, an edge of the splash guard is supported at the step surface, a lower edge of the ring is supported at the base and at the splash guard, and the ring is made of transparent materials.

In a further preferred embodiment, the miniature water pump is configured with a stainless steel mesh at a water inlet.

In a further preferred embodiment, the drip outlets are configured to be directly opposite the opening of the base.

In a further preferred embodiment, the drip outlets are configured as a rosette-shaped structure.

In a further preferred embodiment, the columns on the opposing sides are connected to form a handle, and the handle has a U-shaped structure.

In a further preferred embodiment, the cloud sink is configured with an LED light module inside.

In a further preferred embodiment, the base is uniformly configured with foot-pads at a bottom, the base is installed with a battery, and the base is further configured with a charging socket at the bottom.

The present disclosure has at least following advantages by adopting above technical solutions. The dropping humidifier of the present disclosure, by setting rosette-shaped drip outlets at the bottom of the cloud sink uniformly, a number of drip outlets uninterruptedly drip water, imitating the sound of rain and rain brought about by humidification effect, the humidification effect is better and decorative atmosphere is excellent. In addition, the cloud sink is configured with an LED light module inside, which can present a soft light effect, not only to play an effect of night light, but also decorative atmosphere. Moreover, by setting the splash guard and the transparent ring above the water storage area, it can not only amplify the effect of dripping echo, but also prevent water droplets from splashing and improving desktop cleanliness, and the transparent ring is removable, easy to dismantle the recycling eyelets for cleaning. Additionally, Drip drop strikes the water storage area, which can diffuse essential oils (if added) into the air for a scented effect (when the water storage tank drops with the essential oils).

Figure 1:
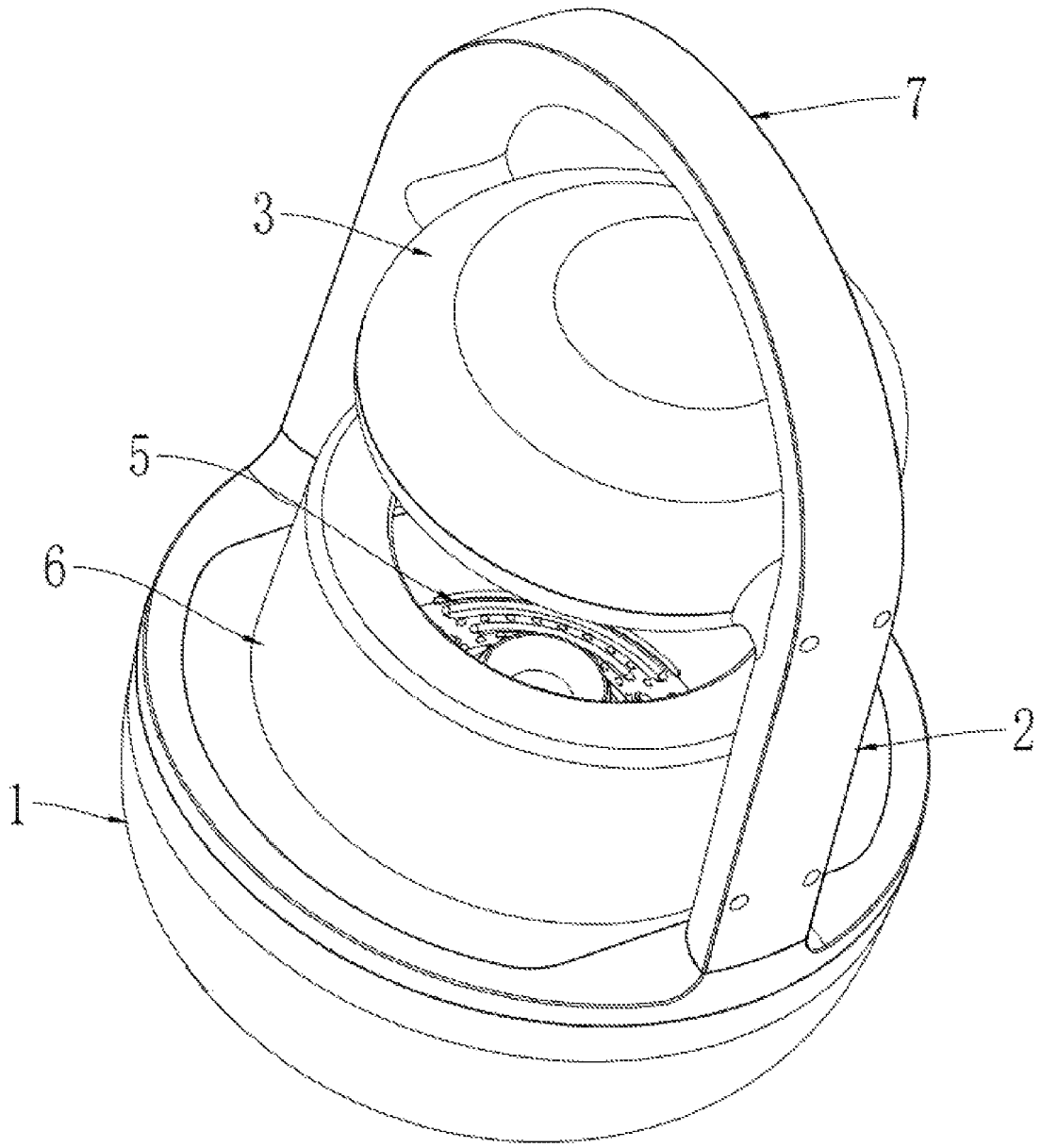
FIG. 1 illustrates a schematic diagram of an overall structure of a novel dripping humidifier in accordance with some embodiments of the present disclosure.
Figure 2:
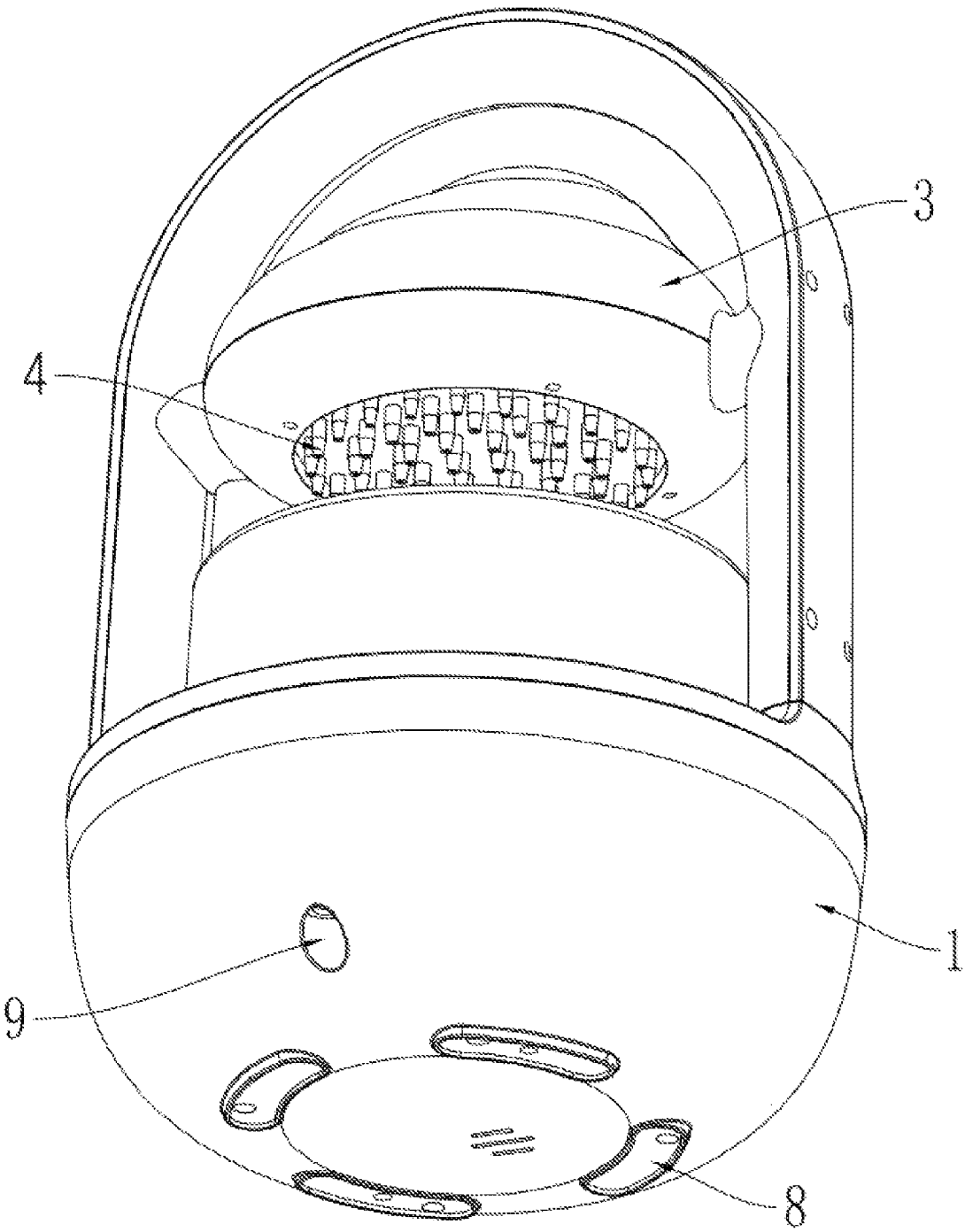
FIG. 2 illustrates a schematic diagram of an upward view of a novel dripping humidifier in accordance with some embodiments of the present disclosure.

In the drawings, the reference signs are as follows. 1. base, 2. column, 3. cloud sink, 4. drip outlet, 5. splash guard, 6. ring, 7. handle, 8. foot-pad, 9. charging socket, 10. miniature water pump, 11. storage water tank, 12. Pipes, 13. water intake, 14. curved surface, 15. outer periphery, 16. step surface, 17. LED module, 18. battery.

DETAILED DESCRIPTION OF THE EMBODIMENTS

The technical solutions of the present disclosure will be clearly and completely described below in conjunction with the accompanying drawings, and it is obvious that the described embodiments are a part of the embodiments of the present disclosure, and not all of them. Based on the embodiments in the present disclosure, all other embodiments obtained by a person of ordinary skill in the art without making creative labor fall within the scope of protection of the present disclosure.

In the description of the present disclosure, it should be noted that the terms "center", "top", "bottom", "left", "right", "vertical", "horizontal", "inner", "outer", etc. indicating the orientation or positional relationships are based on the orientation or positional relationships shown in the accompanying drawings, and are intended only to facilitate and simplify the description of the present disclosure, not to indicate or imply that the device or element referred to must have a particular orientation, be constructed and operate in a particular orientation, and therefore are not to be construed as limiting the present disclosure. Furthermore, the terms "first", "second", and "third" are used for descriptive purposes only and are not to be construed as indicating or implying relative importance. The present disclosure is described in further detail below in conjunction with the accompanying drawings.

As shown in FIG. 1 to FIG. 4, in some embodiments, the present disclosure provides a novel dripping humidifier, including a base 1. The base 1 is uniformly configured with foot-pads 8 at bottom. The base 1 inside is configured with a miniature water pump 10 and a storage water tank 11, the miniature water pump 10 is configured with a stainless steel mesh at a water inlet for filtering to prevent the pump from clogging. A top of the base 1 on opposite sides are configured with columns 2, and the columns 2 on the opposing sides are connected to form a handle 7 having a U-shaped structure, which is convenient for hand-held movement. A cloud sink 3 is configured to mount on connections in the middle of the columns 2 on the opposing sides, the cloud sink 3 is configured with an LED module 17 inside, the LED module 17 can present a soft light effect, not only play an effect of night light, but also decorative atmosphere. The columns 2 are configured with internal pipes 12 that connect to the miniature water pump 10 and the cloud sink 3 respectively. The miniature water pump 10 pumps water from the storage water tank 11 through internal pipes in the columns 2 to the cloud sink 3 above. The cloud sink 3 is uniformly configured with drip outlets 4 at bottom, the drip outlets 4 are configured as a rosette-shaped structure. Water pumped into cloud sink 3 drips continuously through multiple drip outlets 4 to mimic the sound and humidification effect brought by rain. The base 1 is configured with an opening on a top wall, and the opening in the base 1 is fitted with a splash guard 5 and a ring 6. The splash guard 5 is configured with a water intake 13, the ring 6 is distributed around the opening in the base 1 and protrudes from the base 1. Water droplets are not easy to splash and will not wet the desktop, a transparent ring 6 is removably mounted on the splash guard 5, and the transparent ring 6 is detachably for easy removal and cleaning.

Figure 3:
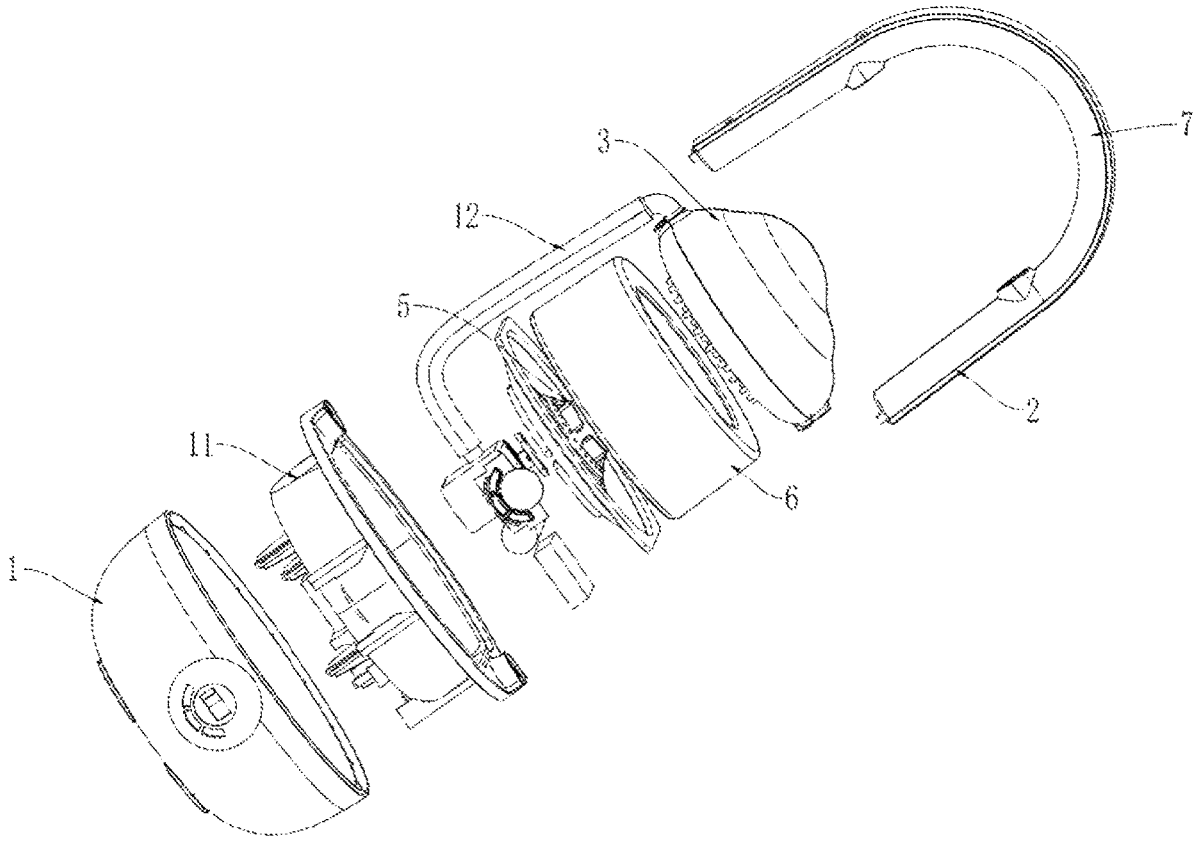
FIG. 3 illustrates an exploded view of a novel dripping humidifier in accordance with some embodiments of the present disclosure.
Figure 4:
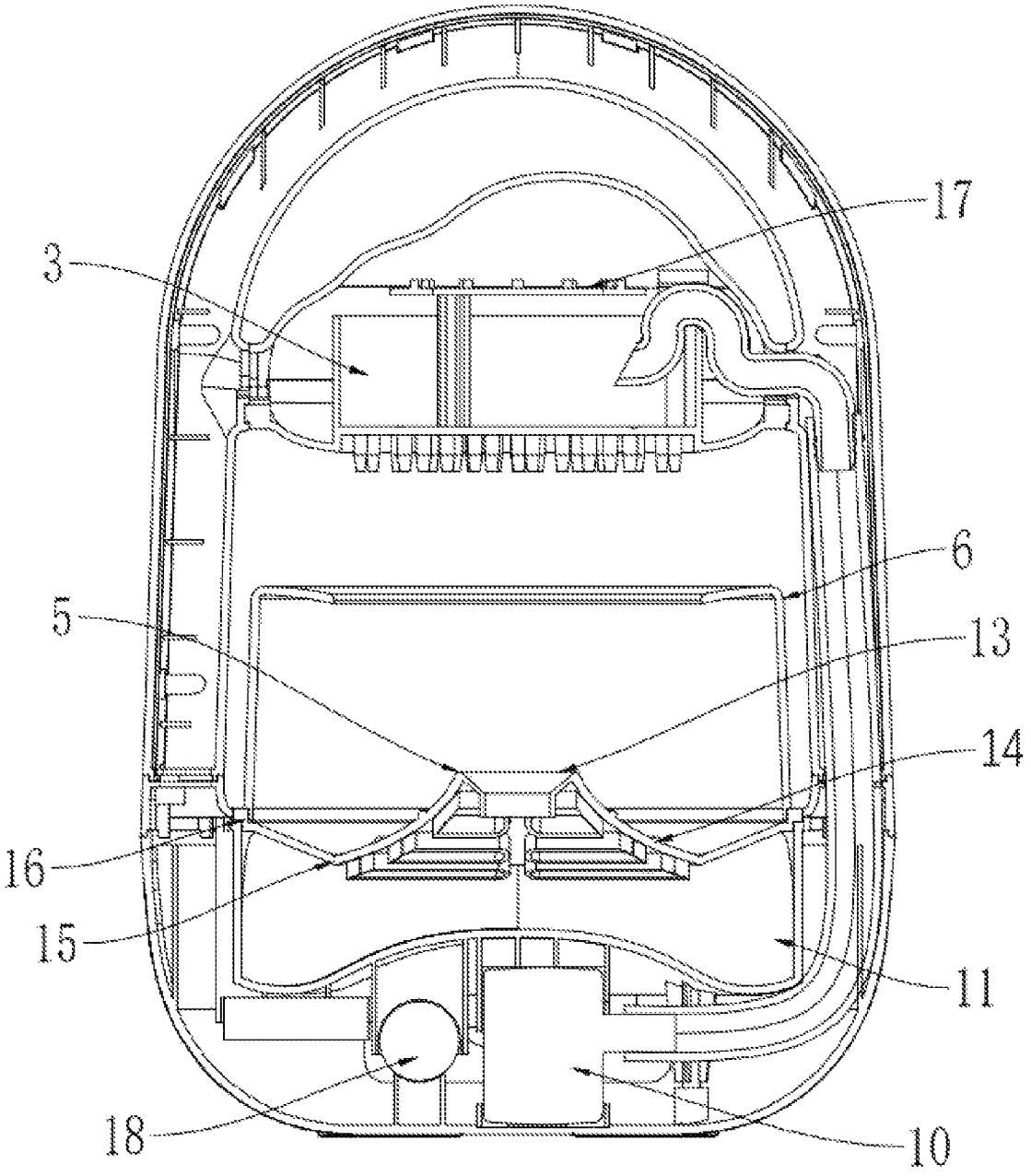
FIG. 4 illustrates a cross-sectional view of a novel dripping humidifier in accordance with some embodiments of the present disclosure.

Referring to FIG. 3 and FIG. 4, the splash guard 5 is configured as a conical platform at a center, the splash guard 5 is configured with a curved surface 14 on a peripheral wall, and the splash guard 5 is configured with the water intake 13 at the center and at the curved surface 14 thereof. The splash guard 5 is configured with an outer periphery 15 at an outermost side, the outer periphery 15 is inclined and slopes downwardly from an outer edge of the splash guard 5 towards the center. The base 1 is configured with a step surface 16, an edge of the splash guard 5 is supported at the step surface 16, a lower edge of the ring 6 is supported at the base 1 and at the splash guard 5, and the ring 6 is made of transparent materials.

Referring to FIG. 3 and FIG. 4, the base 1 is installed with a battery 18, and the base 1 is further configured with a charging socket 9 at the bottom.

In specific use, water or a small amount of essential oils (if needed) is added to the storage water tank 11, the charging socket 9 is plugged into a power source to charging the battery 18, and the battery 18 provides power supply. The miniature water pump 10 starts to work to pump the water into the storage water tank 11 through internal pipes 12 in the columns to the cloud sink 3 above. Water pumped into the cloud sink 3 drips continuously through multiple drip outlets 4 to mimic the sound and humidification effect brought by rain. The drip outlets recycle water through the recycling eyelets 4 into the storage water tank 11, the splash guard 5 and the transparent ring 6 can prevent water drops from splashing and keep the desktop clean. If the essential oils have been added to the water storage tank 11, the essential oils will be diffused into the air during the processing of water droplets falling and water droplets hitting the storage water tank 11 (the water tank and pipes are made of PP material which is resistant to the essential oils) to form a scent effect. In addition, the cloud sink 3 is configured with an LED module 17 inside. In an example, the LED module 17 is a LED light panel, which can present a soft light effect, not only to play an effect of night light, but also decorative atmosphere.

The present disclosure and its embodiments are described above, such description are not limiting, and what is shown in the accompanying drawings is only one of the embodiments of the present disclosure, and the actual structure is not limited thereto. In short, if a person of ordinary skill in the art is inspired by it, and without departing from the inventive purpose of the present disclosure, designs without creativity a structural manner and embodiment similar to the technical solution, all of them shall fall within the scope of protection of the present disclosure.

What is claimed is:

1. A dripping humidifier, comprising a base (1), the base (1) inside is configured with a miniature water pump (10) and a storage water tank (11), a top of the base (1) on opposing sides are configured with columns (2);

a cloud sink (3) is configured to mount on connections of the columns (2) on the opposing sides, the columns (2) are configured with internal pipes (12) that connect to the miniature water pump (10) and the cloud sink (3) respectively, the cloud sink (3) is uniformly configured with drip outlets (4) at bottom;

the base (1) is configured with an opening on a top wall, and the opening in the base (1) is fitted with a splash guard (5) and a ring (6); and the splash guard (5) is configured with a water intake (13), the ring (6) is distributed around the opening in the base (1) and protrudes from the base (1).

2. The dripping humidifier according to claim 1, wherein the splash guard (5) is configured as a conical platform at a center, the splash guard (5) is configured with a curved surface (14) on a peripheral wall, and the splash guard (5) is configured with the water intake (13) at the center and at the curved surface (14) thereof;

the splash guard (5) is configured with an outer periphery (15) at an outermost side, the outer periphery (15) is inclined and slopes downwardly from an outer edge of the splash guard (5) towards the center; and the base (1) is configured with a step surface (16), an edge of the splash guard (5) is supported at the step surface (16), a lower edge of the ring (6) is supported at the base (1) and at the splash guard (5), and the ring (6) is made of transparent materials.

3. The dripping humidifier according to claim 2, wherein the miniature water pump (10) is configured with a stainless steel mesh at a water inlet.

4. The dripping humidifier according to claim 3, wherein the drip outlets (4) are configured to be directly opposite the opening of the base (1).

5. The dripping humidifier according to claim 4, wherein the drip outlets (4) are configured as a rosette-shaped structure.

6. The dripping humidifier according to claim 5, wherein the columns (2) on the opposing sides are connected to form a handle (7), and the handle (7) has a U-shaped structure.

7. The dripping humidifier according to claim 6, wherein the cloud sink (3) is configured with an LED module (17) inside.

8. The dripping humidifier according to claim 7, wherein the base (1) is uniformly configured with foot-pads (8) at a bottom, the base (1) is installed with a battery (18), and the base (1) is further configured with a charging socket (9) at the bottom.

* * * * *